US009010567B2

(12) United States Patent
Pink et al.

(10) Patent No.: US 9,010,567 B2
(45) Date of Patent: Apr. 21, 2015

(54) LID

(76) Inventors: Theresa Pink, Palmdale, CA (US); Pauline East, Quartz Hill, CA (US); Stephen DeVito, Salem, NH (US); Kelly Manners, Roach, MO (US)

( * ) Notice: Subject to any disclaimer, the term of this patent is extended or adjusted under 35 U.S.C. 154(b) by 2190 days.

(21) Appl. No.: 12/002,439

(22) Filed: Dec. 17, 2007

(65) Prior Publication Data

US 2008/0185381 A1 Aug. 7, 2008

Related U.S. Application Data

(60) Provisional application No. 60/874,973, filed on Dec. 15, 2006.

(51) Int. Cl.

| | |
|---|---|
| ***A47G 19/22*** | (2006.01) |
| ***B65D 1/32*** | (2006.01) |
| ***B65D 43/02*** | (2006.01) |

(52) U.S. Cl.

CPC .. *B65D 43/0212* (2013.01); *B65D 2543/00046* (2013.01); *B65D 2543/00092* (2013.01); *B65D 2543/00222* (2013.01); *B65D 2543/00296* (2013.01); *B65D 2543/00537* (2013.01); *B65D 2543/00611* (2013.01); *B65D 2543/00685* (2013.01); *B65D 2543/00722* (2013.01); *B65D 2543/00796* (2013.01)

(58) Field of Classification Search

USPC ..... 220/711–718, 253, 254.3, 254.9

See application file for complete search history.

(56) References Cited

U.S. PATENT DOCUMENTS

| | | | | |
|---|---|---|---|---|
| 4,714,173 | A * | 12/1987 | Ruiz | 220/709 |
| 5,090,584 | A * | 2/1992 | Roberts et al. | 220/712 |
| 5,197,624 | A * | 3/1993 | Dodaro | 220/254.3 |
| 5,894,952 | A * | 4/1999 | Mendenhall et al. | 220/713 |
| 6,287,671 | B1 * | 9/2001 | Bright et al. | 428/195.1 |
| 6,883,677 | B2 * | 4/2005 | Goeking et al. | 220/713 |
| 2006/0060590 | A1 * | 3/2006 | Goeking et al. | 220/713 |
| 2006/0261068 | A1 * | 11/2006 | Schmidtner et al. | 220/254.9 |
| 2007/0034629 | A1 * | 2/2007 | Mazzarolo | 220/254.3 |

* cited by examiner

*Primary Examiner* — Robert J Hicks
*Assistant Examiner* — Shawn M Braden
(74) *Attorney, Agent, or Firm* — John W. Carpenter

(57) ABSTRACT

A lid for covering a container having a consumable liquid. The lid comprises a top, and a first rim coupled to and supported by the top. A spout is connected to and supported by the top, and a second rim is connected to and is supported by the first rim. The lid includes a lower rim assembly, and a recess assembly coupled to a lower surface of the second rim and to an upper surface of the lower rim assembly.

11 Claims, 7 Drawing Sheets

LID

CROSS-REFERENCE TO RELATED APPLICATIONS

This patent application is related to Provisional Patent Application having application No. 60/874,973, filed Dec. 15, 2006, and fully incorporated herein by reference thereto as if repeated verbatim immediately herein. Benefit of the Dec. 15, 2006 filing date for the Provisional Patent Application is claimed.

FIELD OF THE INVENTION

Embodiments of the present invention are related to a lid for a container containing consumable liquids.

BACKGROUND OF THE INVENTION

There are a number of lids available for securing to a top of a container containing consumable liquids, such as soft drinks and coffee. However, none combine the features a lid for a container having a top designed for preventing spills of a consumable liquid from the container.

SUMMARY OF EMBODIMENTS OF THE INVENTION

Embodiments of the present invention provide a lid for a container. The lid has a top, and a first rim coupled to and supported by the top. A spout is connected to and is supported by the top. The lid has a second rim connected to and supported by the first rim. The lid includes a lower rim assembly, and a recess assembly coupled to a lower surface of the second rim and to an upper surface of the lower rim assembly.

These provisions, together with the various ancillary provisions and features which will become apparent to those skilled in the art as the following description proceeds, are attained by the methods and assemblies of the present invention.

DETAILED DESCRIPTION OF THE EMBODIMENTS OF THE INVENTION

In the description herein, numerous specific details are provided, such as examples of components and/or methods, to provide a thorough understanding of the embodiments of the present invention. One skilled in the relevant art will recognize, however, that an embodiment of the invention may be practiced without one or more of the specific details, or with other apparatus, systems, assemblies, methods, components, materials, parts, and/or the like. In other instances, well-known structures, materials, or operations are not specifically shown or described in detail to avoid obscuring aspects of the embodiments of the present invention.

Figure 1:
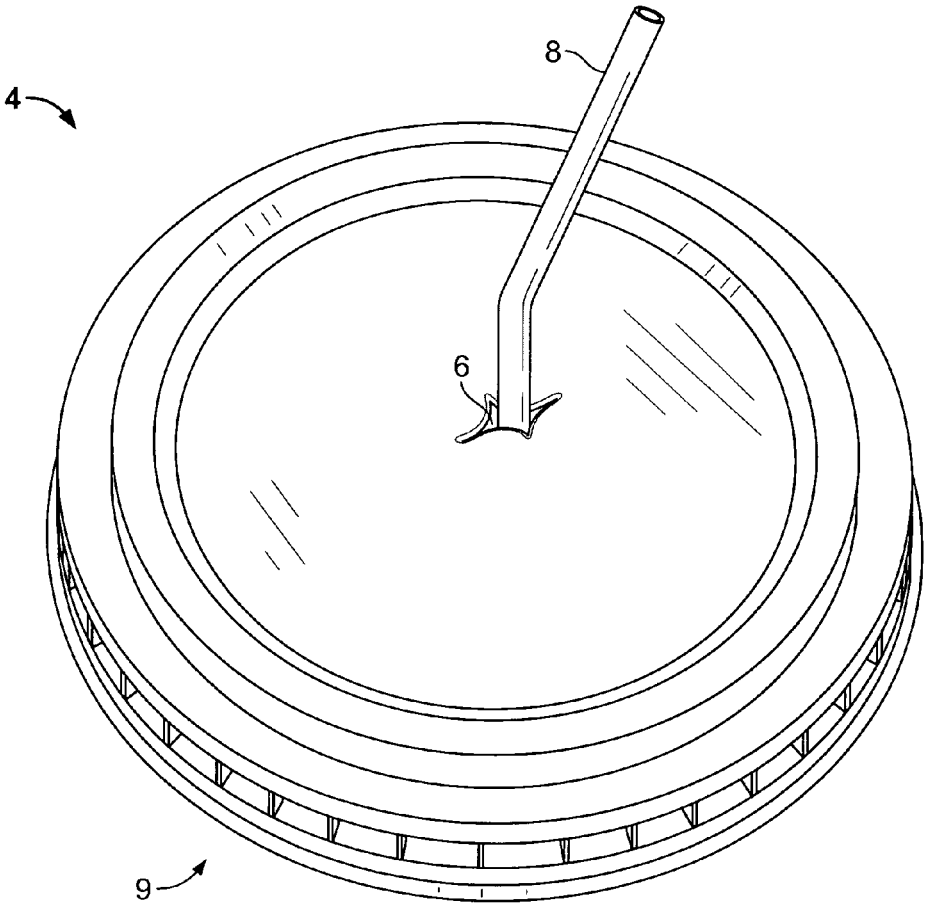
FIG. 1 (Prior Art)
FIG. 1 is a partial perspective view of a prior art lid secured to a container.
Figure 2:
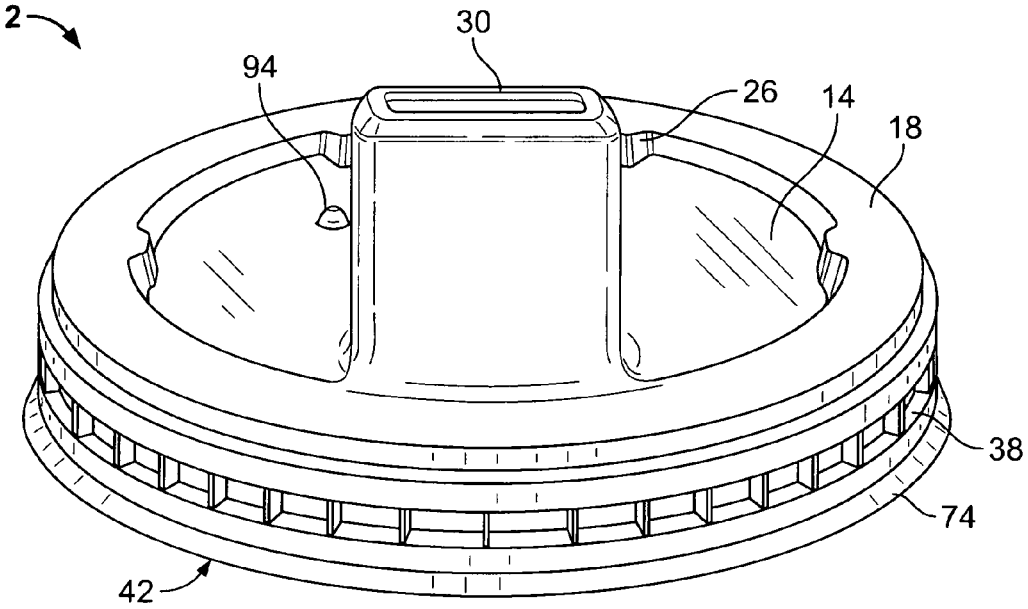
FIG. 2 is a perspective view of the lid from the front.
Figure 3:
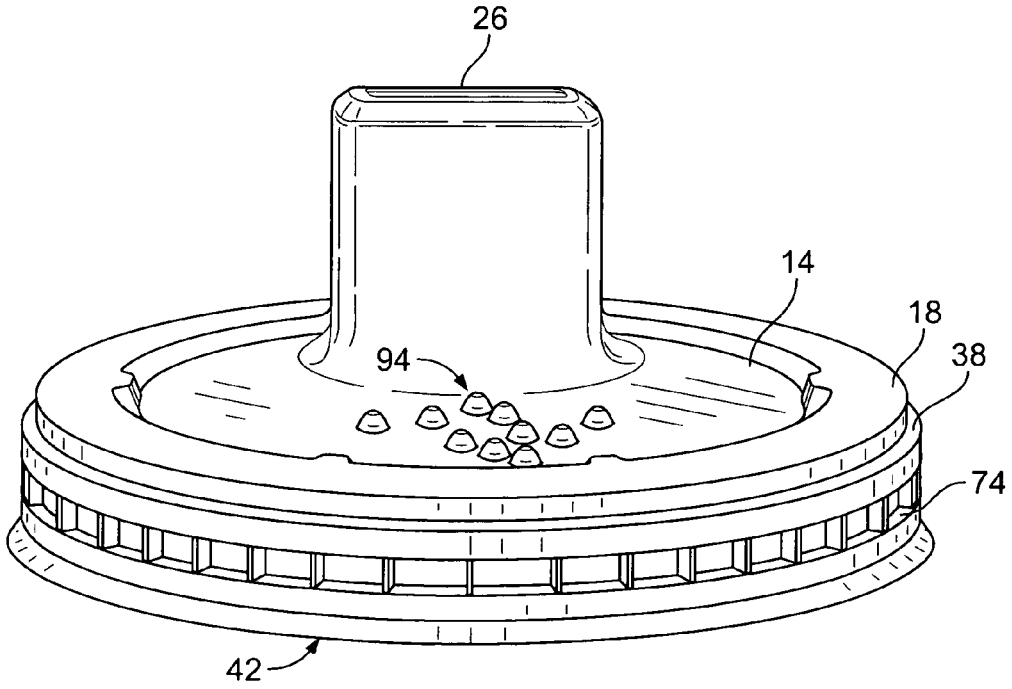
FIG. 3 is a perspective view of the lid from the back.
Figure 4:
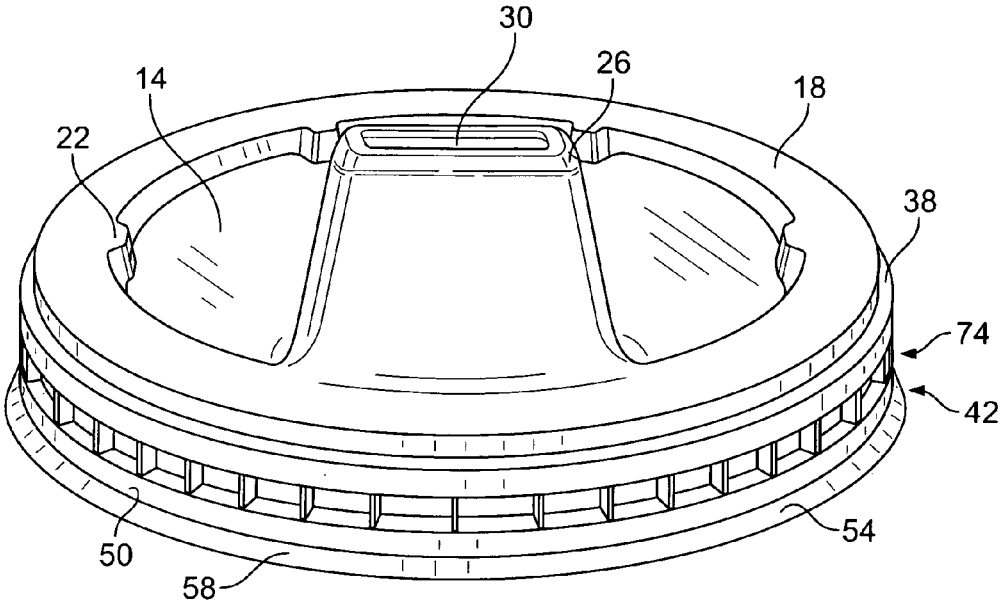
FIG. 4 is another perspective view of the lid from the front.
Figure 5:
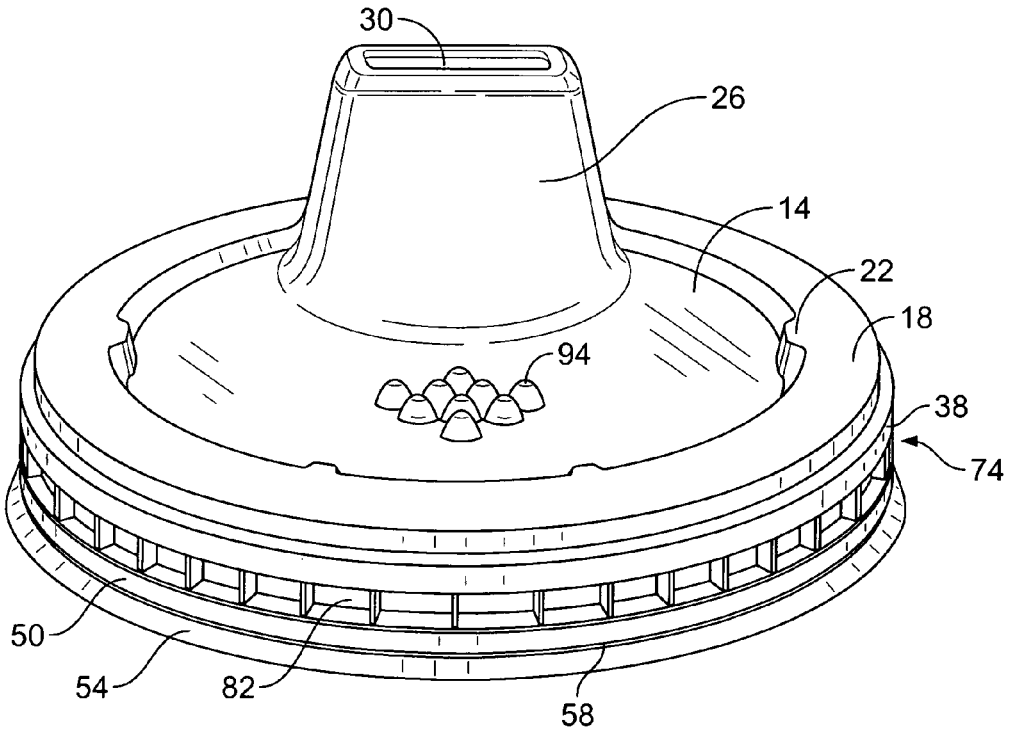
FIG. 5 is another perspective view of the lid from the back.
Figure 6:
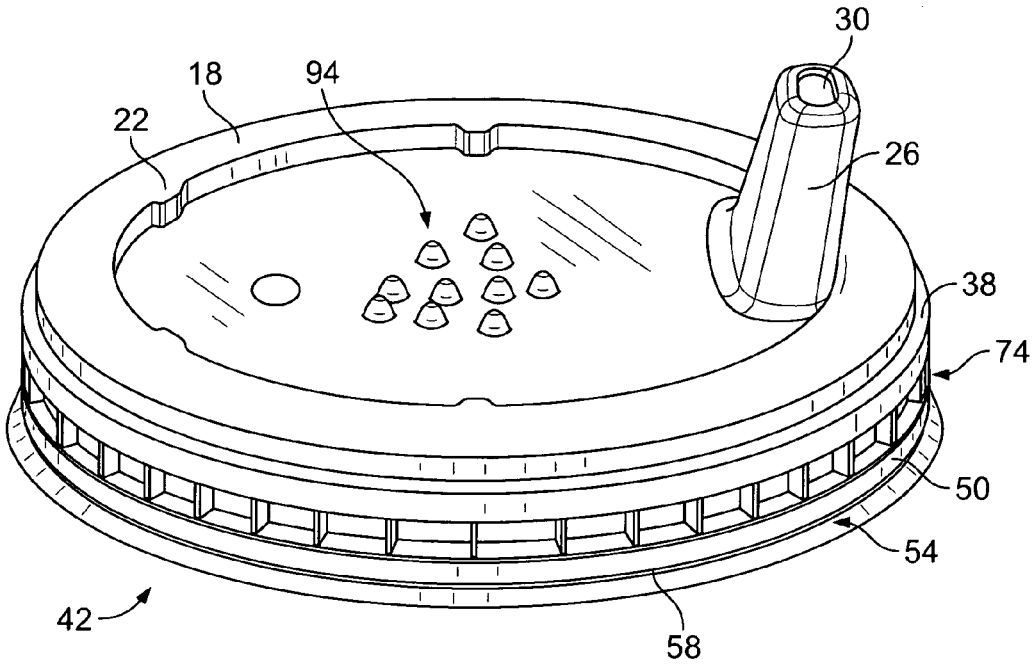
FIG. 6 is a perspective view of the lid from the side.
Figure 7:
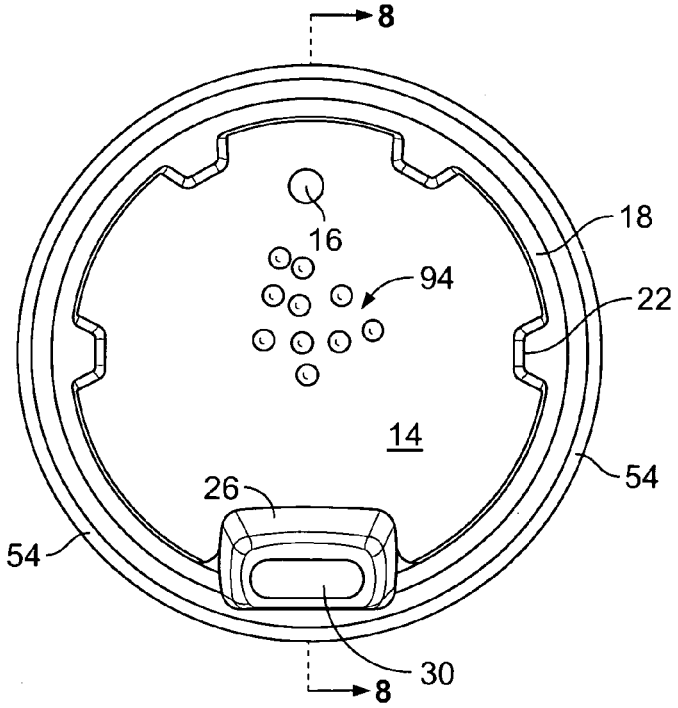
FIG. 7 is a top plan view of the lid.
Figure 8:
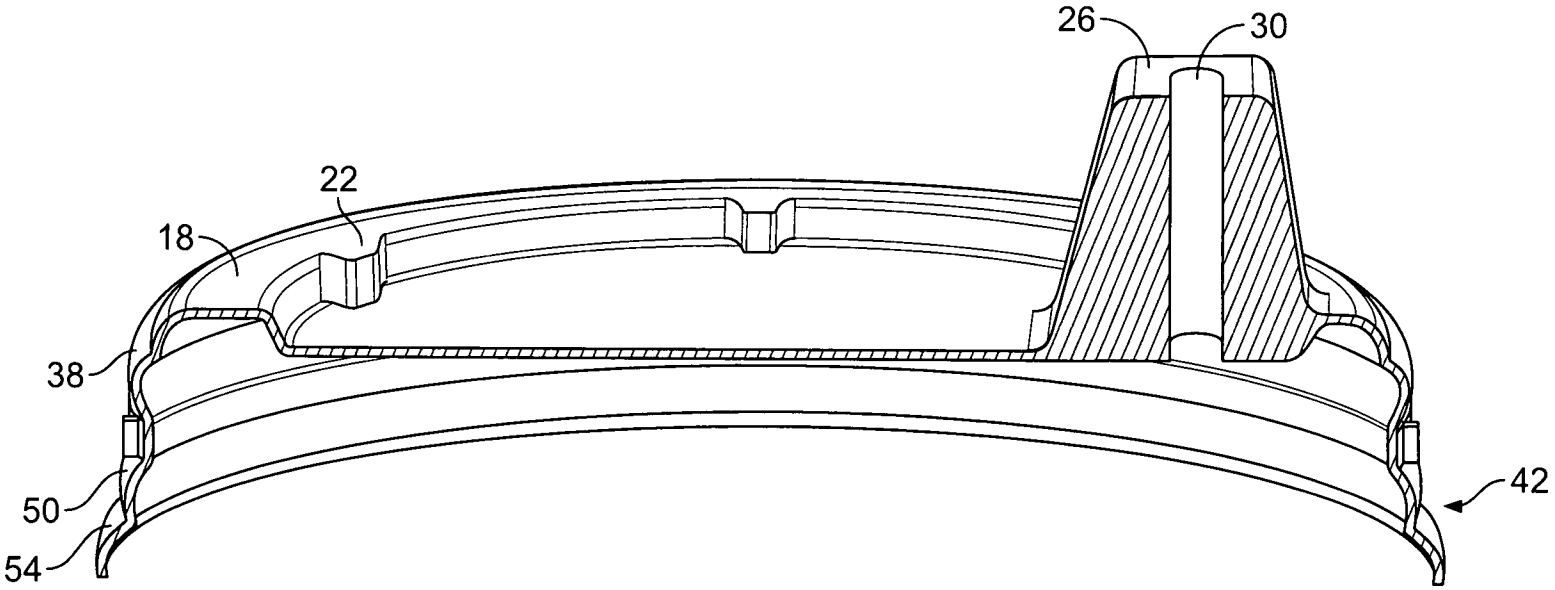
FIG. 8 is a vertical perspective view taken in direction of the arrows and along the plane of line 8-8 in FIG. 7.
Figure 9:
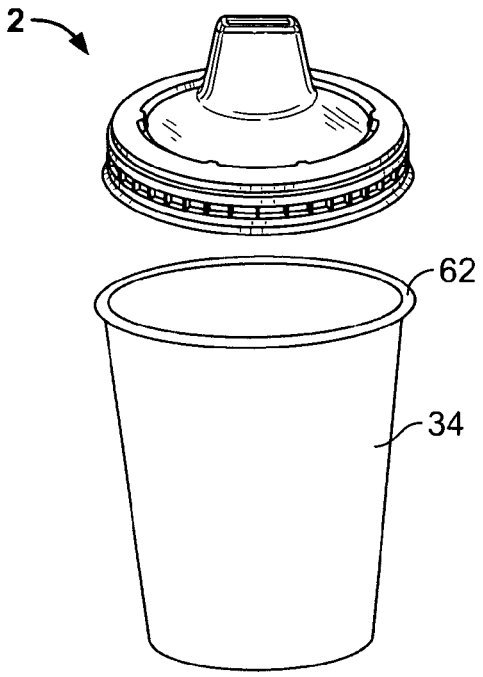
FIG. 9 is a segmented view of the lid and a container.
Figure 10:
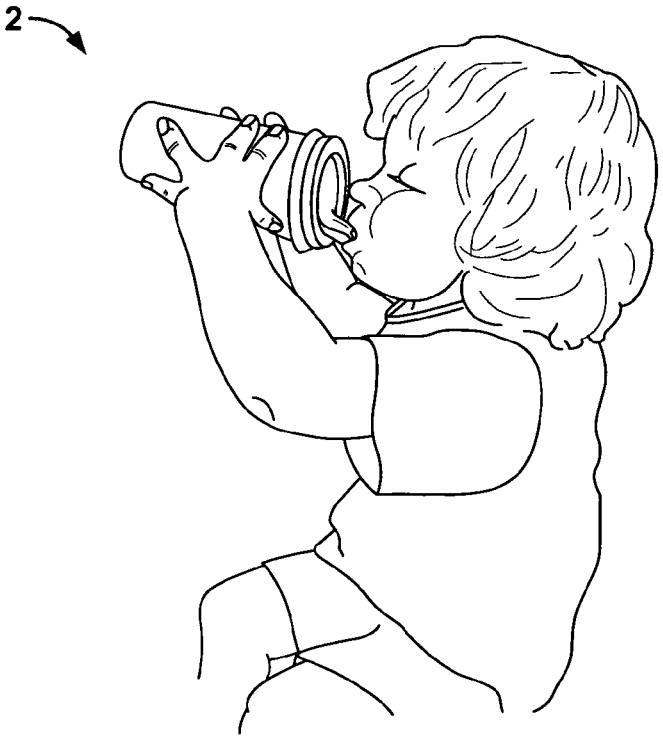
FIG. 10 is a perspective view of the lid-container combination in use by a person.
Figure 11:
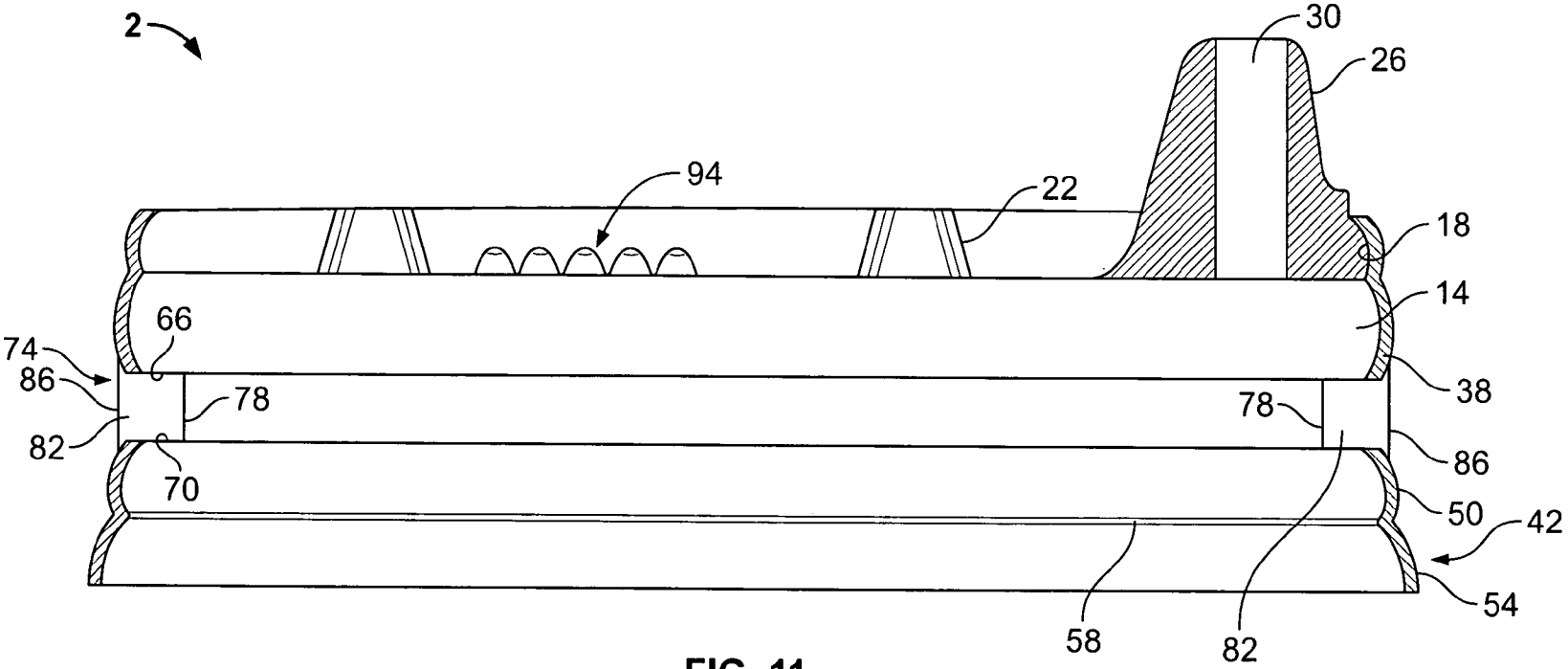
FIG. 11 is a vertical sectional view taken in direction of the arrows and along the plane of line 8-8 in FIG. 7.

Referring in detail now to the drawings, wherein similar parts of the invention are identified by like reference numerals, there is seen in FIG. 1 a prior art lid 4 having a hole 6 and a straw 8 passing through a hole 6. The lid 4 is coupled to and supported by a top of a container 9.

In FIGS. 2-11 there is seen an embodiment of the improved lid 2 having a top 14, and an upper rim 18 coupled to and supported by the top 14 which includes a vent 16. Rim 18 has a plurality of inward extending notches 22 connected to the top 14. A spout 26 is connected to and is supported by the top 14. Spout 26 is also coupled to the rim 18. Spout 26 has an opening 30 where through a consumable liquid passes from a container 34. Rim 18 is connected to and supported by support rim 38. The lid 2 also has a lower rim assembly 42. A plurality of clustered ridges 94 is connected to the top 14. In an embodiment of the invention, ridges 94 may be arranged to spell any suitable indicia (i.e., words or logos, such as "KidzLidz") which may represent a trademark or product name of the lid 2.

The lower rim assembly 42 has a rim section 50 secured to a lower rim section 54 at score line 58. Rim section 50 has a diameter that is less than the diameter of lower rim section 54 which defines a skirt which readily pivots or biasedly extends outwardly to firmly secure to the top 62 of the container.

Disposed between a lower surface 66 of the rim 38 and an upper surface 70 of rim section 50 is a recess assembly 74 which includes a recess wall 78 secured to the lower surface 66 and the upper surface 70. Recess wall 78 is circular and has a diameter which is less than the diameter of rims 18, 38, rim sections 50 and 54. The recess assembly 74 also includes a plurality of outwardly extending wall members 82 which are spaced from each other. The wall members 82 define sprockets having outer edges 86 that generally register with the outer surfaces of rim section 50 and rim 38.

The lid 2 may be manufactured from any suitable material, preferably a biodegradable material. In an embodiment of the invention, the lid 2 may be manufactured by developing a pattern. After developing a pattern, an RTV silicone mold of the pattern is made. From the mold, one or multiples of a solid vacuum formed buck is produced. The buck is then vented and holes are drilled in the appropriate areas to allow the passage of a vacuum through them, ensuring a tight vacuum formed pull (i.e., the act of drawing heated material over the buck) and subsequently ensuring transference of the detail of the buck to the heated material. The buck is then positioned in the center of the vacuum formed machine platen. The vacuum formed material (e.g., 0.2 or 0.03 polystyrene or PETG p-plastic) is heated to such a degree that it can be vacuum drawn over the buck. The vacuum formed machines heat is then turned off and the material is allowed to cool for a few minutes before the vacuum is turned off. At this time, the buck is removed from the material which is then gross trimmed. After gross trimming, the finished piece is inserted into a custom-trimming jig and the excess material is excised. Holes are then punched in the nozzle area, using a custom jig, and a vent hole is punched in the flat portion of the lid above the logo (i.e., ridges 94).

Reference throughout this specification to "one embodiment", "an embodiment", or "a specific embodiment" means that a particular feature, structure, or characteristic described in connection with the embodiment is included in at least one embodiment of the present invention and not necessarily in all its embodiments. Therefore, the respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any arrows in the drawings/figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of the illustrated embodiments of the present invention and are to be included within the spirit and scope of the present invention.

Therefore, while the present invention has been described herein with reference to the particular embodiments thereof, a latitude of modification, various changes and substitutions are intended in the foregoing disclosures, and it will be appreciated that in some instances some features of the embodiments of the invention will be employed without the corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. A lid for covering a container, said lid comprising a top having a top planar surface, a first rim coupled to and supported by the top, a spout having an opening and connected to and supported by the top and secured to said first rim, a second rim connected to supported by the first rim, a lower rim assembly, and a recess assembly coupled to a lower surface of the second rim and an upper surface of the lower rim assembly; a cluster of distinct ridges connected to the top and centrally disposed on the top planar surface; and a plurality of inwardly extending notches bound to the first rim and disposed on the top planar surface and protruding towards the clustered ridges.

2. The lid of claim 1 wherein said lower rim assembly comprises a first rim section having said upper surface, and a second rim section coupled to the first rim section via a score line.

3. The lid of claim 2 wherein said recess assembly comprises a circular recess wall connected to the lower surface of the second rim and to the upper surface of the first rim section, and a plurality of outwardly extending wall members which are secured to the lower surface of the second rim and to the upper surface of the first rim section.

4. The lid of claim 3 wherein each of said wall members has an outer edge that generally registers with the outer surface of the second rim and the outer surface of the first rim section.

5. The lid of claim 3 wherein said circular recess wall of said recess assembly has a diameter that is less than the diameter of the first rim, the second rim, and the first and second rim sections.

6. The lid of claim 2 wherein said first rim section has a diameter that is less than the second rim section.

7. The lid of claim 6 wherein said score line has a diameter that is less than the diameter of the second rim section.

8. The lid of claim 1 additionally comprising a container coupled to the lid.

9. The lid of claim 8 additionally comprising a consumable liquid disposed in the container.

10. The lid of claim 1 wherein said ridges are cone-shaped to facilitate the spelling of indicia.

11. The lid of claim 1 wherein said top includes a vent and said ridges are disposed on the top planar surface between the vent and the spout.

* * * * *